US007048555B2

(12) United States Patent
Ono

(10) Patent No.: US 7,048,555 B2
(45) Date of Patent: May 23, 2006

(54) BATTERY CONNECTOR

(75) Inventor: Naoyuki Ono, Shinagawa-ku (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 11/020,904

(22) Filed: Dec. 22, 2004

(65) Prior Publication Data

US 2005/0142928 A1 Jun. 30, 2005

(30) Foreign Application Priority Data

Dec. 26, 2003 (JP) ..... 2003-433509

(51) Int. Cl.
*H01R 12/00* (2006.01)

(52) U.S. Cl. ..... 439/83; 439/224

(58) Field of Classification Search ..... 439/83, 439/224, 31, 79, 876
See application file for complete search history.

(56) References Cited

U.S. PATENT DOCUMENTS 4,975,062 A * 12/1990 Evans et al. ..... 439/13
5,915,979 A 6/1999 Schell et al.
6,328,600 B1 * 12/2001 Fujiki et al. ..... 439/570
2005/0186813 A1 * 8/2005 Lohr ..... 439/79

FOREIGN PATENT DOCUMENTS

EP 1 037 317 A2 9/2000
WO 97/45896 12/1997

* cited by examiner

*Primary Examiner*—Ross Gushi
(74) *Attorney, Agent, or Firm*—Pearne & Gordon LLP

(57) ABSTRACT

In a battery connector BC, after a contact member is fitted to a housing, an identical plane formed by a fitting bottom surface portion of a printed-wiring-board mounting portion of the contact member and a first housing outer wall surface is formed as a first printed-wiring-board mounting surface, and an identical plane formed by a fitting side surface portion and a second housing outer wall surface is formed as a second printed-wiring-board mounting surface. Thus a connector housing can be mounted on a printed wiring board by soldering by either one of the two printed-wiring-board mounting surfaces.

6 Claims, 3 Drawing Sheets

BATTERY CONNECTOR

BACKGROUND OF THE INVENTION

The present invention relates to a battery connector, and more particularly to a battery connector for a portable device which is used by being fixed to a printed wiring board (PWB) by soldering or the like.

A battery connector is generally used by being connected to a subject substrate incorporated in an electronic device mounted on a printed wiring board (PWB). Terminal ends of contact members are exposed from a housing of the battery connector, and soldering portions project therefrom in flat form.

A 3P battery connector P1, which is a battery connector of a first related art shown in FIGS. 4 and 5, has three contact members 101 constituted by U-shaped spring portions inside a housing 100. As shown in FIG. 5 illustrating a cross section taken along line B—B in FIG. 4, a rear-end extended portion of each contact member 101 is bent toward the rear in an L-shape in a cross-sectional view. The rearwardly bent portion is formed as a soldering portion 102, and the battery connector P1 is attached by soldering to a printed wiring board 3 by soldering by means of one surface of each of the soldering portions 102.

Further, a 4P battery connector P2 which is a battery connector of a second related art shown in FIGS. 6 and 7 has a housing 200 and four contact members 201 constituted by U-shaped spring portions. A rear-end extended portion of each contact member 201 is formed as a soldering portion 202 projecting toward the printed wiring board 3, and is attached by being inserted in an attaching hole in the printed wiring board 3 at the time of attachment.

Furthermore, both the battery connector P1 of the first related art and the battery connector P2 of the second related art are structured such that as for the surface which is mounted on the printed wiring board, only one surface can be used.

With the battery connectors P1 and P2 of the first and second related arts, the printed-wiring-board mounting surface for mounting on the printed wiring board is provided only on one surface of the housing on the side where the soldering portions of the contact members are provided. For this reason, the battery connector at its limited single mounting surface is conventionally mounted on the printed wiring board 3. Accordingly, since all the shapes of the battery connectors mounted on the printed wiring boards 3 are the same, if the shape and the size of a mating portion such as a socket for fitting the battery connector mounted on the printed wiring board 3 changes, it is impossible to cope with the situation. Hence, there has been a need to newly form a battery connector of a different shape conforming thereto.

In addition, with the battery connectors P1 and P2 of the first and second related arts, since they have single soldering portions 102 projecting from the housing 100, there has been a problem in that the battery connectors cannot be made further compact. There has been another problem in that at the time of soldering the soldering portion 102 and the printed wiring board 3, a mounting offset occurs due to the surface tension of the solder.

SUMMARY OF THE INVENTION

In order to solve the aforesaid problems, the invention is characterized by having the following arrangement.

(1) A connector comprising:

a housing that includes a fitting recessed portion for receiving a contact member, a wall end portion, a first outer wall surface facing in a first direction and a second outer wall surface facing in a second direction different from the first direction; and the contact member including, a spring body for contacting with a plate body inserted from an outside, a fitting portion that is received in the fitting recessed portion and has a shape corresponding to that of the fitting recessed portion, a mounting portion fitted to the wall end portion, a fitting bottom surface portion in plane with the first outer wall surface, and a fitting side surface portion in plane with the second outer wall surface, wherein a first surface defined by the fitting bottom surface and the first outer wall surface constitutes a first mounting surface for mounting a printed wiring board, and a second surface defined by the fitting side surface portion and the second outer wall surface constitutes a second mounting surface for mounting the printed wiring board, whereby either one of the first and second mounting surfaces can be mounted on the printed wiring board by soldering.

(2) The connector according to (1), wherein the first direction is substantially perpendicular to the second direction.

(3) The connector according to (2), wherein the fitting bottom surface portion connects the fitting portion to the fitting side surface portion to define the mounting portion, a recess is defined between the fitting portion and the fitting side surface portion, to which the wall end portion is fitted, and the fitting bottom surface extends in the first direction and the fitting side surface portion extends in the second direction.

(4) The connector according to (3), wherein a pair of curved outer surfaces are formed between the fitting portion and the fitting bottom surface portion and between the fitting bottom surface portion and the fitting side surface portion, respectively.

(5) The connector according to (4), wherein when the first surface is mounted to the printed wiring board, the pair of curved outer surfaces are soldered, and when the second surface is mounted to the printed wiring board, one of the pair of curved outer surface between the fitting bottom surface portion and the fitting side surface portion and a side surface end of the fitting side surface portion are soldered.

(6) The connector according to (1), wherein the wall end portion and the second outer wall surface defines a part of the fitting recessed portion.

According to the invention, soldering portions for mounting the contact members on the printed wiring board can be provided on two printed-wiring-board mounting surfaces of the battery connector, making it possible to mount the battery connector on a plurality of mating fitting members having different shapes.

In addition, according to the invention, the soldering portion is an outer surface on each side of a fitting bottom surface portion or each side of a fitting side surface portion. Therefore, fillets which are formed by the surface tension at the time of the melting of solder are formed at two portions of the U-shape. Hence, even if the soldering area is small, satisfactory soldering strength is provided, and a self-alignment effect at the time of soldering is provided.

DETAILED DESCRIPTION OF PREFERRED EMBODIMENTS

Figure 1:
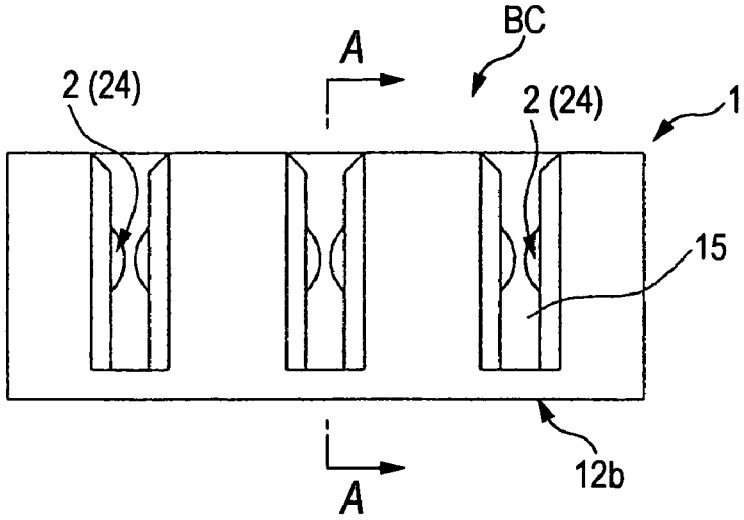
FIG. 1 is a front elevational view illustrating a battery connector in accordance with an embodiment the invention.
Figure 2:
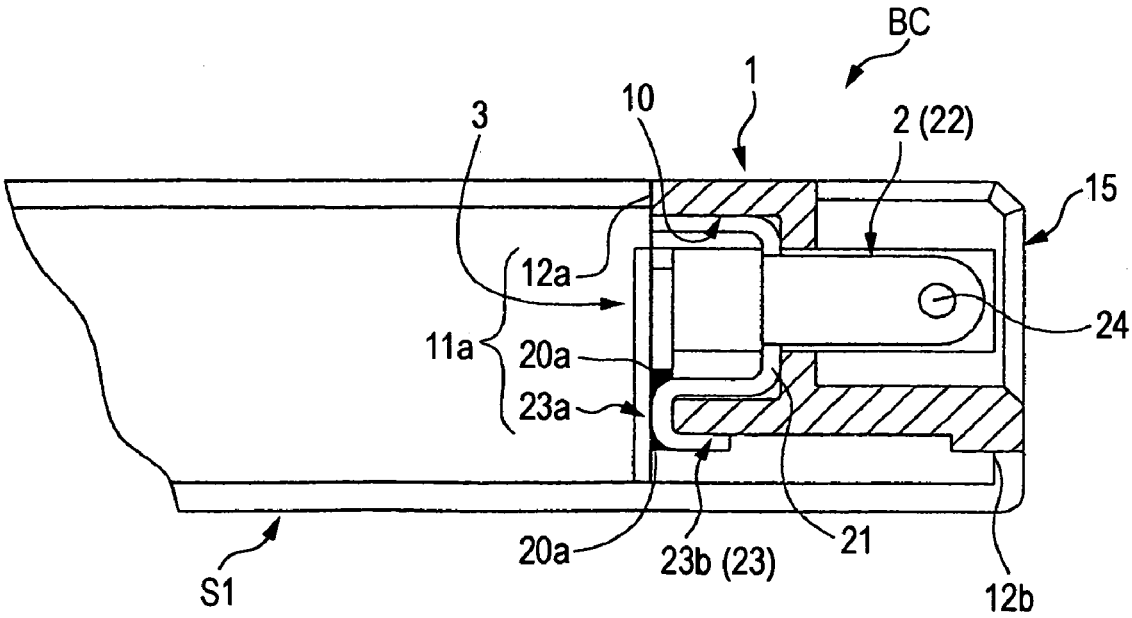
FIG. 2 shows a state of use in which the battery connector in which a printed wiring board is fitted to a first printed-wiring-board mounting surface of the battery connector shown in FIG. 1 is fitted to one socket, and is a partially cutaway explanatory diagram in which the battery connector portion shows a cross section taken along line A—A in FIG. 1.
Figure 3:
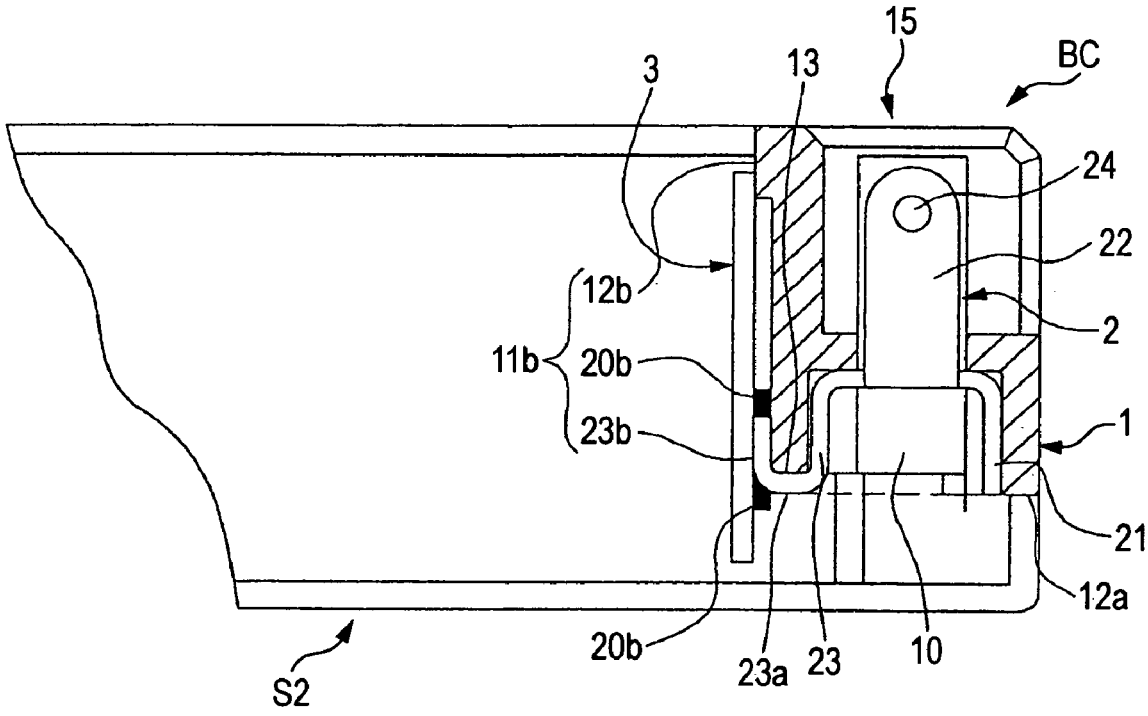
FIG. 3 shows a state of use in which the battery connector in which a printed wiring board is fitted to a second printed-wiring-board mounting surface of the battery connector shown in FIG. 1 is fitted to another socket, and is a partially cutaway explanatory diagram in which the battery connector portion shows a cross section taken along line A—A in FIG. 1.
Figure 4:
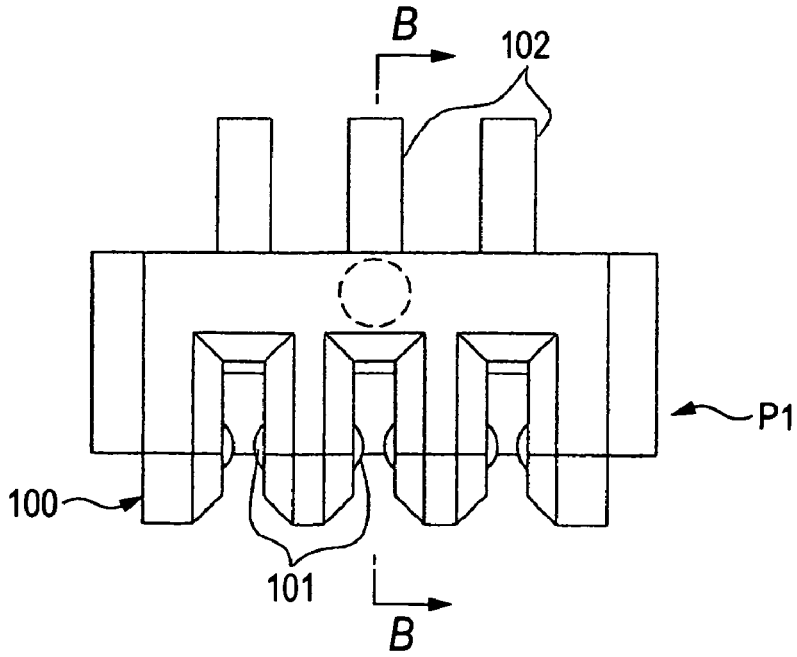
FIG. 4 is a plan view of a battery connector of a first related art.
Figure 5:
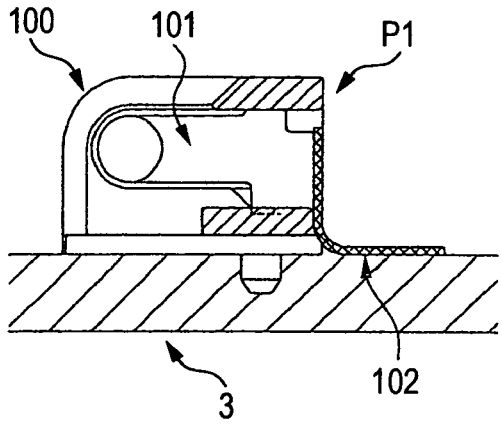
FIG. 5 illustrates the first related art and is a cross-sectional view taken along line B—B in FIG. 4.
Figure 6:
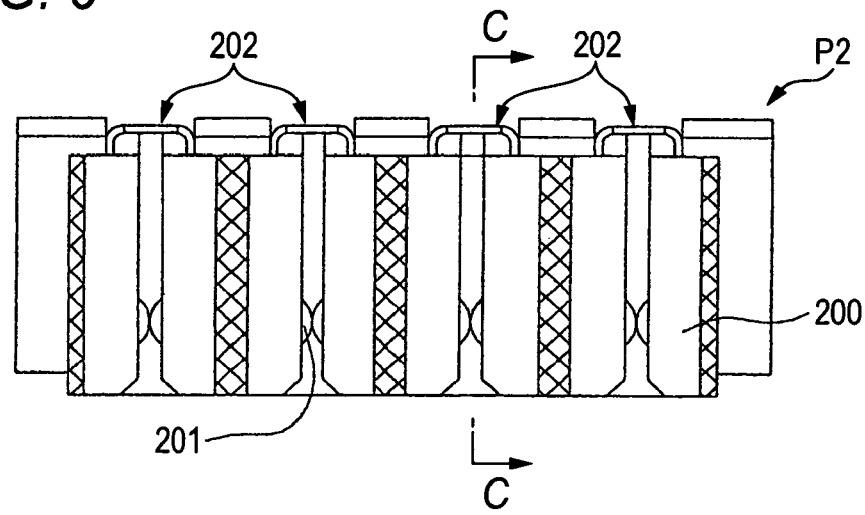
FIG. 6 is a plan view of a battery connector of a second related art.
Figure 7:
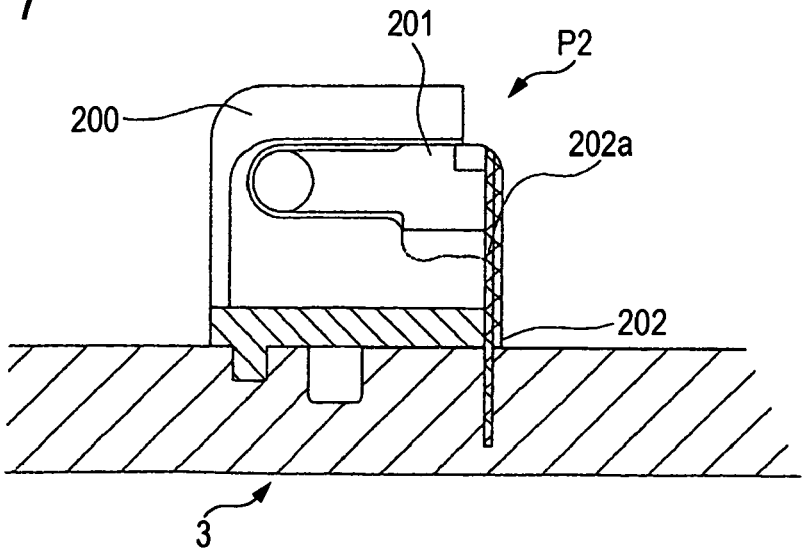
FIG. 7 illustrates the second related art and is a cross-sectional view taken along line C—C in FIG. 6.

Referring to FIGS. 1 to 3 illustrating an embodiment of the invention, a description will be given of a battery connector BC of the invention. FIG. 1 is a front elevational view illustrating the embodiment of the battery connector BC in accordance with the invention; FIG. 2 shows a state of use in which the battery connector in which a printed wiring board is fitted to a first printed-wiring-board mounting surface of the battery connector shown in FIG. 1 is fitted to one socket, and is a partially cutaway explanatory diagram in which the battery connector portion shows a cross section taken along line A—A in FIG. 1. FIG. 3 shows a state of use in which the battery connector in which a printed wiring board is fitted to a second printed-wiring-board mounting surface of the battery connector shown in FIG. 1 is fitted to another socket, and is a partially cutaway explanatory diagram in which the battery connector portion shows a cross section taken along line A—A in FIG. 1

The battery connector BC in accordance with the embodiment of the invention is comprised of a housing 1 and contact members 2, and is mounted on a printed wiring board 3 by soldering by means of soldering portions 20 of the contact members 2.

The housing 1 is a substantially rectangular parallelepiped whose outer surfaces consist of six sides. The housing 1 includes a contact-member fitting recessed portion 10 which is a recessed portion capable of fitting to a fitting portion 21 of each contact member 2, which will be described later, by coming into close contact therewith with a corresponding shape; a wall end portion 13 capable of fitting to a printed-wiring-board mounting portion 23 of each contact member 2; an outer wall surface 12*a* for forming a surface flush with that of a fitting side surface portion 23*a* of each contact member 2; and an outer wall surface 12*b* for forming a surface flush with that of a fitting side surface portion 23*b* of each contact member 2. The housing 1 has a plurality of openings 15 for contacts in two surfaces other than printed-wiring-board mounting surfaces 11*a* and 11*b*.

The contact member 2 has a spring body 22 which is U-shaped in a plan view of a bottom view, the fitting portion 21 which is a member continuing from the rear surface side of this spring body 22 and has a shape corresponding to the contact-member fitting recessed portion 10 of the housing 1, and the printed-wiring-board mounting portion 23 capable of engaging the housing wall end portion 13. The printed-wiring-board mounting portion 23 in this embodiment is U-shaped as viewed from the cross section taken along line A—A in FIG. 1. The fitting side surface portion 23*a* is a U-shaped bottom surface portion, while the fitting side surface portion 23*b* is one side surface portion located on the outer side of the U-shape. The U-shaped spring body 22 has the action of coming into contact by clamping from both sides by means of a leaf spring, and has a pair of opposing contact projections 24 capable of contacting a contact plate member (not shown), which is inserted from the outside through the opening 15 for the contact in the housing 1.

The first printed-wiring-board mounting surface 11*a* consists of the outer wall surface 12*a* which is a portion of the housing 1, as well as the fitting-bottom surface portion 23*a* of the printed-wiring-board mounting portion 23 which is fitted to the wall end portion 13, i.e., a portion of the same housing 1. The outer wall surface 12*a* and the fitting bottom surface portion 23*a* form an identical plane with the fitting portion 21 of the contact member 2 placed therebetween. In a case where the mounting surface of the printed wiring board 3 is mounted in contact with this plane, a curved outer surface portion on each side at either end of the fitting bottom portion 23*a* (U-shaped bottom surface portion) serves as a soldering portion 20*a*.

The other second printed-wiring-board mounting surface 11*b* consists of the outer wall surface 12*b* which is a portion of the housing 1, as well as the fitting bottom surface portion 23*b* of the printed-wiring-board mounting portion 23 which is fitted to the wall end portion 13, i.e., a portion of the same housing 1. The outer wall surface 12*b* and the fitting bottom surface portion 23*b* form an identical plane with a space portion 14 placed therebetween. In a case where the mounting surface of the printed wiring board 3 is mounted in contact with this plane, one curved outer side surface of the U-shape and a side surface end of the U-shape, which are both end portions, serves as soldering portions 20*b*. In this embodiment, the second printed-wiring-board mounting surface 11*b* has a rectangular shape more elongated than the first printed-wiring-board mounting surface 11*a*.

Next, a description will be given of the operation in which the 3P battery connector BC in accordance with the embodiment of the invention is mounted on the mounting surface of the printed wiring board 3, as well as its action. As for the battery connector, the contact members 2 are fitted in the interior of the housing 1 by fitting the respective fitting portions 21 to the contact-member fitting recessed portions 10. At this time, the U-shaped printed-wiring-board mounting portion 23 is engaged with the wall end portion 13 of the housing 1 in such a manner as to clamp it by its U-groove. The contact projections 24 of each contact member 2 are provided at positions where they can be viewed through the openings 15 for contacts.

With the battery connector BC in accordance with the embodiment of the invention, in the state in which the contact members 2 are fitted in the housing 1, two printed-wiring-board mounting surfaces 11*a* and 11*b* are formed including the first printed-wiring-board mounting surface 11*a* having the fitting bottom surface portion 23*a* and the second printed-wiring-board mounting surface 11*b* having the fitting side surface portion 23*b*.

Next, either the short first printed-wiring-board mounting surface 11*a* or the long second printed-wiring-board mounting surface 11*b* is selected depending on the shape, width, size of a socket S1, a socket S2, or the like for fitting this battery connector BC, and is mounted by soldering between the soldering portions 20*a* or 20*b* and the printed wiring board 3. FIG. 2 shows an example in which the battery connector BC is fitted to the socket S1 in a state in which the printed wiring board 3 is attached to the first printed-wiring-board mounting surface 11*a* in correspondence with the narrow socket S1. FIG. 3 shows an example in which the battery connector BC is fitted to the socket S2 in a state in which the printed wiring board 3 is attached to the second printed-wiring-board mounting surface 11*b* in correspondence with the wide socket S2.

At this time, the soldering portions 20*a* and 20*b* make it possible to stabilize the solder, and prevent the scattering of the molten solder to the housing interior due to the flux gas generated on heating and when the solder melts.

According to the invention, since at least two printed-wiring-board mounting surfaces are formed which can be mounted with respect to the printed wiring board of a battery connector for a portable device such as a portable telephone for which a compact size is desirable, and mounting is made possible by selecting one surface. Therefore, the invention offers an advantage in mounting in conformity with the shape and size of the mating attaching portion on which the battery connector for the portable device is provided. Hence, its utility as a battery connector for a portable device is high.

What is claimed is:

1. A connector comprising:

a housing that includes a fitting recessed portion for receiving a contact member, a wall end portion, a first outer wall surface facing in a first direction and a second outer wall surface facing in a second direction substantially perpendicular to the first direction; and the contact member including, a U-shaped spring body having multiple projections to clamp a plate body from both sides, a fitting portion that is received in the fitting recessed portion and has a shape corresponding to that of the fitting recessed portion, a mounting portion fitted to the wall end portion, a fitting bottom surface portion in plane with the first outer wall surface, and a fitting side surface portion in plane with the second outer wall surface, wherein a first surface defined by the fitting bottom surface and the first outer wall surface constitutes a first mounting surface for mounting a printed wiring board, and a second surface defined by the fitting side surface portion and the second outer wall surface constitutes a second mounting surface for mounting the printed wiring board, whereby either one of the first and second mounting surfaces can be mounted on the printed wiring board by soldering.

2. The connector according to claim 1, wherein the wall end portion and the first outer wall surface defines a part of the fitting recessed portion.

3. The connector according to claim 1, wherein the fitting portion initially extends perpendicularly away from a side of the spring body.

4. The connector according to claim 1, wherein the fitting bottom surface portion connects the fitting portion to the fitting side surface portion to define the mounting portion, wherein a recess is defined between the fitting portion and the fitting side surface portion, to which the wall end portion is fitted, and wherein the fitting bottom surface extends in the first direction and the fitting side surface portion extends in the second direction.

5. The connector according to claim 4, wherein a pair of curved outer surfaces are formed between the fitting portion and the fitting bottom surface portion and between the fitting bottom surface portion and the fitting side surface portion, respectively.

6. The connector according to claim 5, wherein when the first surface is mounted to the printed wiring board, the pair of curved outer surfaces are soldered, and wherein when the second surface is mounted to the printed wiring board, one of the pair of curved outer surface between the fitting bottom surface portion and the fitting side surface portion and a side surface end of the fitting side surface portion are soldered.

* * * * *